United States Patent [19]

Kishi et al.

[11] Patent Number: 4,799,257

[45] Date of Patent: Jan. 17, 1989

[54] WIRELESS TRANSMISSION SYSTEM FOR PM MODULATION SIGNAL

[75] Inventors: Masahichi Kishi, Tokyo; Seizo Seki; Noboru Kanmuri, both of Kanagawa, all of Japan

[73] Assignee: Nippon Telegraph & Telephone Public Corporation, Tokyo, Japan

[21] Appl. No.: 119,231

[22] Filed: Nov. 5, 1987

Related U.S. Application Data

[63] Continuation of Ser. No. 656,376, Oct. 1, 1984, abandoned.

[30] Foreign Application Priority Data

Sep. 30, 1983 [JP] Japan ..... 58-180636
Sep. 8, 1984 [JP] Japan ..... 59-187277

[51] Int. Cl.[4] ..... H04K 1/04

[52] U.S. Cl. ..... 380/9; 380/31; 380/38; 380/39

[58] Field of Search ..... 380/9, 34, 38, 31, 39

[56] References Cited

U.S. PATENT DOCUMENTS

| | | | |
|---|---|---|---|
| 2,408,692 | 10/1946 | Shore | 380/38 |
| 3,123,672 | 3/1964 | Ross | 380/9 |
| 3,560,659 | 2/1971 | Greefkes et al. | 375/30 |
| 3,723,878 | 3/1973 | Miller | 455/30 |
| 3,808,536 | 4/1974 | Reynolds | 179/1.5 S |
| 3,925,611 | 12/1975 | Dennis | 380/9 |
| 4,176,321 | 11/1979 | Horn | 179/1.5 S |
| 4,355,401 | 10/1982 | Ikoma et al. | 455/26 |
| 4,433,211 | 2/1984 | McCalmont et al. | 179/1.5 S |
| 4,525,844 | 6/1985 | Scheuermann | 455/26 |
| 4,551,580 | 11/1985 | Cox et al. | 179/1.5 S |
| 4,726,064 | 2/1988 | Kishi et al. | 380/9 |

OTHER PUBLICATIONS

"Automated Maritime Telephone System" by Komura et al., Japan Telecommunications Review, 10/77, pp. 304–312.

*Primary Examiner*—Salvatore Cangialosi
*Attorney, Agent, or Firm*—Armstrong, Nikaido, Marmelstein & Kubovcik

[57] ABSTRACT

A wireless transmitter for PM (phase modulation) signal with a spectrum scrambler for relocation of input spectrum for privacy purposes is comprised of a differential circuit coupled with an input terminal, a spectrum scrambler coupled with output of said differential circuit, and FM (frequency modulation) modulator coupled with output of the spectrum scrambler. Due to the position of the differential circuit before the spectrum scrambler, modulation index of modulated PM signal and/or the frequency band of the modulated PM signal does not increase irrespective of spectrum scrambling.

5 Claims, 9 Drawing Sheets

Fig. 1 (a) PRIOR ART
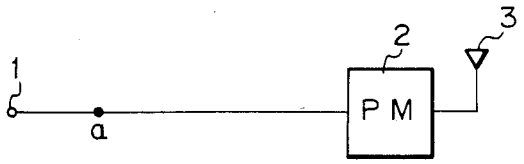
Fig. 1 (b) PRIOR ART
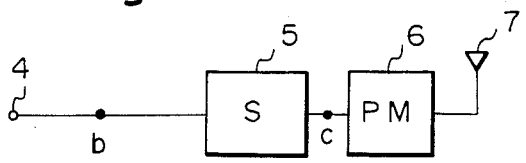
Fig. 2 PRIOR ART
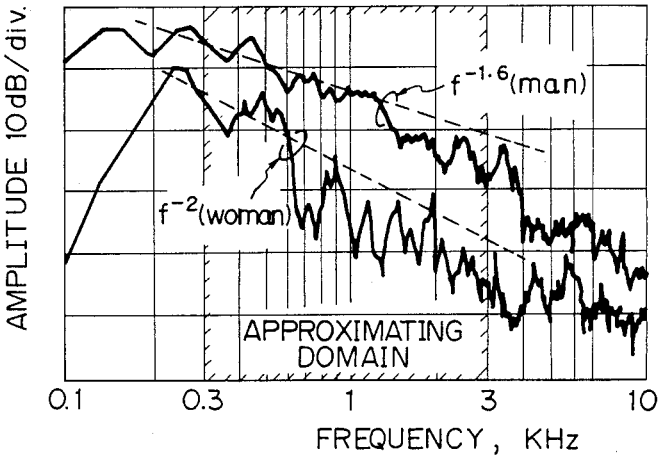

Fig. 8(g)
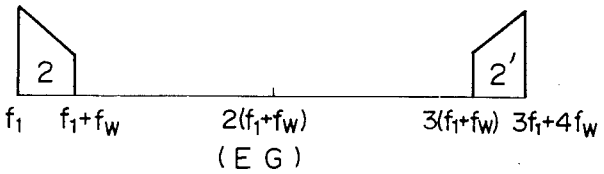
Fig. 8(h)
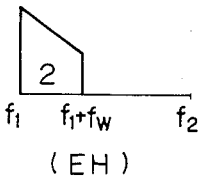
Fig. 8(j)
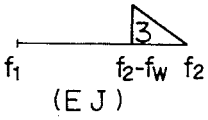
Fig. 8(k)
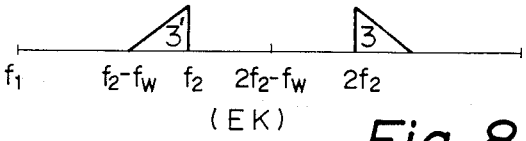
Fig. 8(ℓ)
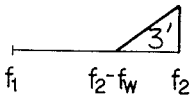
Fig. 8(m)
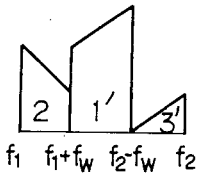

WIRELESS TRANSMISSION SYSTEM FOR PM MODULATION SIGNAL

This application is a continuation of application Ser. No. 656,376, filed Oct. 1, 1984, now abandoned.

BACKGROUND OF THE INVENTION

The present invention relates to a wireless transmission system, and in particular, relates to such a system which improves the privacy characteristics by scrambling the spectrum of input signals, and keeps transmission power constant irrespective of spectrum scrambling. In particular, the present invention relates to a mobile communication system which transmits a signal through a PM (phase modulation) system.

FIG. 1(a) shows a conventional PM transmission system, in which the numeral 1 is an input terminal, 2 is a PM modulator, 3 is a transmission antenna, and the symbol (a) shows an observation point. FIG. 1(b) is the modification of FIG. 1(a), and has a spectrum scrambler which performs the privacy function. In FIG. 1(b), the numeral 4 is an input terminal, 5 is a spectrum scrambler, 6 is a PM modulator, and 7 is a transmission antenna, and the symbols (b) and (c) are observation points.

The transmission modulation index $Dev_{PM}$ of FIG. 1(a), and the modulation index $Dev_{EX}$ of FIG. 1(b) are given in the meaning of effective power as shown as follows.

$$Dev_{PM} = \int_{f_1}^{f_2} f^2 G(f) df \tag{1}$$

$$Dev_{EX} = \int_{f_1}^{f_2} f^2 S[G(f)] df \tag{2}$$

where $Dev_{PM}$ is the transmission modulation index in FIG. 1(a), $Dev_{EX}$ is the transmission modulation index in FIG. 1(b), G(f) is power spectrum of arbitrary input signals, S(*) is spectrum scramble function, f is frequency, and $f_1$ and $f_2$ are lower and upper limits of the pass band (which is 0.3 to 3 kHz domain in a mobile telephone system).

Input signals of telephone communication are usually speech signals. FIG. 2 shows the power spectrums of speech signals, and the long time average $\hat{G}(f)$ is approximated to $\hat{G}(f)=G_0 f^{-2}$, where $G_0$ is a constant, and the frequency band $[f_1, f_2]$ in a mobile wireless telephone communication is [0.3, 3] kHz.

Now, the analysis of the modulation index $Dev_{PM}$ when a spectrum scrambling is introduced is carried out below, under the strict condition of the spectrum scrambling with a simple spectrum inversion. The symbol S'[*] shows a spectrum inversion, and is shown below.

$$S'[G(f)] = G(f_0 - f),\ f_0 = f + f_2,\ f \in [f_1, f_2] \tag{3}$$

The modulation index $Dev_{PM}$ and $Dev_{EX}$ are deduced by substituting the equation (3) into eqs (1) and (2), respectively.

When a signal $\hat{G}(f)$ is applied to the point (a), the modulation index $Dev_{PM}$ is given below.

$$Dev_{PM} = \int_{0.3}^{3} f^2 G_0 f^{-2} df = 2.7\ G_0 \tag{4}$$

When the signal $\hat{G}(f)$ is applied to the point (b), the signal $T_{EX}$ having the following power spectrum is obtained at the point (c).

$$T_{EX}(f) = S'[\hat{G}(f)] = \hat{G}(f_0 - f)$$

Accordingly, the modulation index $Dev_{EX}$ in case of spectrum inversion is given by equation (5).

$$\begin{aligned} Dev_{EX} &= \int_{0.3}^{3} f^2 T_{EX}(f) dt = \int_{0.3}^{3} f^2 \hat{G}(f_0 - f) df \\ &= \int_{0.3}^{3} f^2 G_0 (f_0 - f)^{-2} df = 20.2\ G_0 \end{aligned} \tag{5}$$

Comparing the equation (4) with the equation (5), the insertion of a spectrum inversion unit before the PM modulator as shown in FIG. 1(b) increases the modulation index by 10 log $(Dev_{EX}/Dev_{PM})=8.7$ dB (power ratio), and it causes consequently the disadvantage of increasing the frequency bandwidth.

FIG. 3 is another prior art method for preventing said increase of the frequency bandwidth. In FIG. 3, the numeral 8 is an input terminal, 9 is a PM modulator, 10 is a transmission antenna, 11 is an attenuator, 12 is a spectrum invertor, 13 is a PM modulator, and 14 is a transmission antenna. The PM modulator 9 and the antenna 10 provide a transmitter for speech signals without any spectrum inversion, and the combination of th attenuator 11, the spectrum invertor, the PM modulator 13 and the antenna 14 provides a transmitter for speech signals with spectrum inversion. However, the use of an attenuator has the disadvantage that a signal to noise ratio (S/N) is deteriorated.

FIG. 4 is still another prior art method for overcoming the increase of the frequency bandwidth, and is shown in the article "Voice quality improvement using compandor and/or emphasis on frequency spectrum inverted secrecy system" in 161 J64-B, No. 5, Pages 425–432, May 1982 published by the Institute of Electronics and Communication in Japan. In FIG. 4, the numeral 15 is an input terminal, 16 is a spectrum inverter, 17 is a pre-emphasis circuit, 18 is a PM modulator, and 19 is an antenna. The symbols (d) and (e) are observation points.

The equipment of FIG. 4 functions to provide the same modulation index $Dev_{EX}$ with secrecy as the modulation index $Dev_{PM}$ without secrecy, only when a spectrum scrambler is a simple spectrum inverter, and an input signal if $\tilde{G}(t)$. This is shown below.

When input signals $\tilde{G}(t)$ are applied to the input terminal 15, simple spectrum inverted signals $G(f_0-f)$ appear at the point (d), and these signals are emphasized by the pre-emphasis circuit 17 ($H_p(f)$), and the signals $\tilde{T}_{EX}(f)$ appear at the point (e).

$$\tilde{T}_{EX}(f) = H_p(f)\tilde{G}(f_0 - f) \tag{6}$$

where:

$$G(f) = \frac{G_0}{1 + (f^2/f_T^2)},\ f_T = 0.8\text{kHz} \tag{7}$$

-continued $$H_p(f) = \frac{1 + (f_0 - f)^2/f_T^2}{1 + f^2/f_T^2} \quad (8)$$

Subsequently, $Dev_{EX}$ is shown as follows.

$$\begin{aligned} Dev_{EX} &= \int_{0.3}^{3} f^2 T_{EX}(f)df = \int_{0.3}^{3} f^2 H_p(f)G(f_0 - f)df \\ &= \int_{0.3}^{3} f^2 \frac{1 + (f_0 - f)^2}{1 + f^2/f_T^2} \frac{G_0}{1 + (f_0 - f)^2/f_T^2} dt \\ &= \int_{0.3}^{3} f^2 G_0/(1 + f^2/f_T^2)df = \int_{0.3}^{3} f^2 G(f)df \end{aligned} \quad (9)$$

Eq. 9 shows clearly that $Dev_{EX}$ coincides with $Dev_{PM}$. However, when speech signals are arbitrary (G(t)), that coincidence between $Dev_{EX}$ and $Dev_{PM}$ is not satisfied even when a spectrum scrambler is restricted to be a simple spectrum inverter. The analysis for a general speech signal is shown below.

$$T_{EX}(f) = H_p(f)G(f_0 - f) = \frac{1 + (f_0 - f)^2}{1 + f^2/f_T^2} G(f_0 - f) \quad (10)$$

Accordingly;

$$Dev_{EX} = \int_{0.3}^{3} f^2 \frac{1 + (f_0 - f)^2/f_T^2}{1 + f^2/f_T^2} G(f_0 - f)df \quad (11)$$

When a new variable x is introduced to be $f_0 - f$, $df = -dx$, the equation (11) becomes to;

$$Dex_{EX} = \int_{3}^{0.3} (f_0 - x)^2 \frac{1 + x^2/f_T^2}{1 + (f_0 - x)^2/f_T^2} G(x)(-dx). \quad (12)$$

The equation (12) is converted to the equation (13) by changing $-dx$ to dx.

$$Dev_{EX} = \int_{0.3}^{3} (f_0 - x)^2 \frac{1 + x^2/f_T^2}{1 + (f_0 - x)^2/f_T^2} G(x)dx \quad (13)$$

On the other hand, the modulation index $Dev_{PM}$ for non-inverted speech signal is expressed as follows.

$$Dev_{PM} = \int_{0.3}^{3} x^2 G(x)dx \quad (14)$$

Comparing the equation (13) with the equation (14), it is apparent that $Dev_{EX}$ does not coincide with $Dev_{PM}$ in case of general input signal G(t) being employed.

The equipment of FIG. 4 solves merely the problem in a very limited case, that is, input signals are restricted to be $\tilde{G}(t)$, and a spectrum scrambler is a simple spectrum inverter, then, $Dev_{EX} = Dev_{PM}$ is satisfied. However, the circuit of FIG. 4 has still the disadvantages that the modulation index and/or the frequency spectrum is increased by introducing a spectrum scrambling process, if input speech signals are general, or if a spectrum scramble is not a simple spectrum inversion.

A general spectrum scramble divides input signals spectrum to plural sub-frequency bands within the input frequency domain, and the scramble changes the location of each of the divided sub-frequency bands. Accordingly, if an emphasis is introduced, that emphasis must be designed for each combination of sub-frequency bands, and of course that is almost impossible without any increase in circuit implementation. Therefore, it has been impossible to provide a constant modulation index irrespective of general spectrum scrambling.

SUMMARY OF THE INVENTION

It is an object, therefore, of the present invention to overcome the disadvantages and limitations of a prior wireless communication system by providing a new and improved transmission system.

It is also an object of the present invention to provide a wireless transmission system, in which a modulation index in PM (phase modulation) is not affected by a spectrum scrambling system.

It is also a further object of the present invention to provide a wireless transmission system, in which a modulation index in PM modulation is not increased by introducing spectrum scramble for speech privacy.

The mentioned above and other objects are attained by a wireless transmission system for transmitting PM signals comprising an input terminal for receiving input signals to be transmitted, a differential circuit coupled with the said input terminal, a spectrum scrambler coupled with the output of said differential circuit for scrambling spectrum of the input signals, an FM modulator coupled with the output of said spectrum scrambler, and an antenna coupled with the output of said FM modulator.

BRIEF DESCRIPTION OF THE DRAWINGS

The foregoing and other objects, features, and attendant advantages of the present invention will be appreciated and understood better by means of the following description and accompanying drawings wherein:

FIG. 1(a) is a block diagram of a prior PM transmission system for non-privacy speech, FIG. 1(b) is a block diagram of a prior PM transmission system with privacy facility of speech privacy, FIG. 2 shows curves of long time average of power spectrum of speech signals.

DESCRIPTION OF THE PREFERRED EMBODIMENTS

Figure 3:
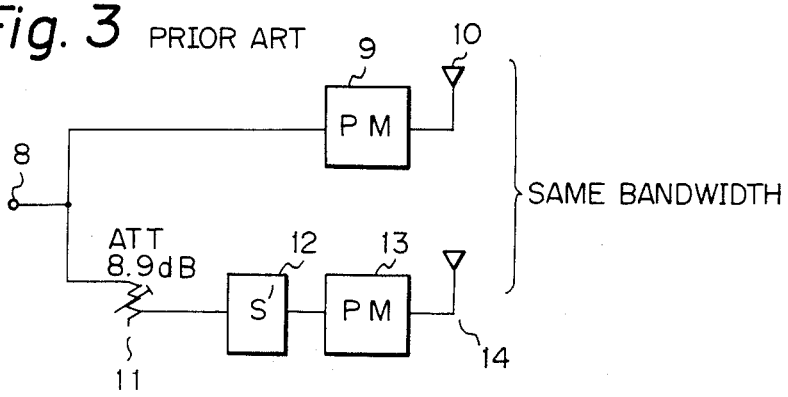
Fig. 3 PRIOR ART
FIG. 3 is a block diagram of another prior transmission system with privacy facility.
Figure 4:
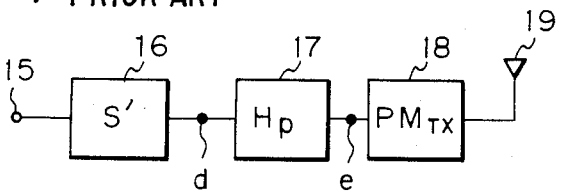
Fig. 4 PRIOR ART
FIG. 4 is a block diagram of still another prior transmission system with privacy facility.
Figure 5A:
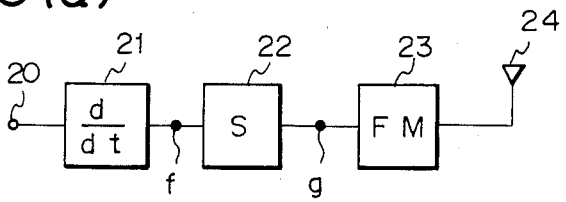
FIG. 5(a) is a block diagram of a PM transmission system according to the present invention.

FIG. 5(a) is a block diagram of the present transmission system, in which the numeral 20 is an input terminal, 21 is a differential circuit, 22 is a spectrum scrambler which changes the spectrum allocation of input signals, 23 is an FM (frequency modulation) modulator, 24 is a transmission antenna, and (f) and (g) are observation points. It should be appreciated in FIG. 5 that the circuit provides a PM modulation due to the presence of a differential circuit 21 and an FM modulator 23, since a FM modulator is accomplished by an FM modulator following a differential circuit.

Figure 5B:
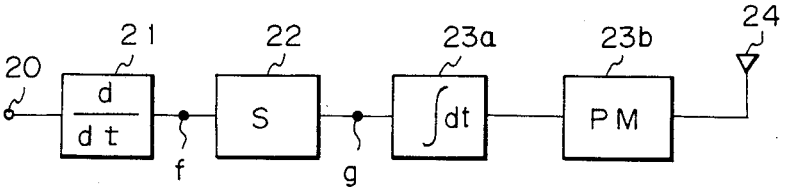
FIG. 5(b) is a block diagram of another PM transmission system according to the present invention.

FIG. 5(b) is the modification of FIG. 5(a), and the feature of FIG. 5(b) is the replacement of the FM modulator 23 of FIG. 5(a) with the combination of the integration circuit 23*a* and the PM modulator 23*b*. It should be noted that the combination of an integration circuit and a PM modulator functions as an FM modulator.

Figure 6:
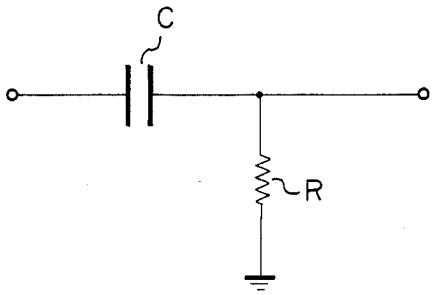
FIG. 6(a) is an example of a differential circuit.
FIG. 6(b) shows frequency response to the circuit shown in FIG. 6(a)
Figure 6:
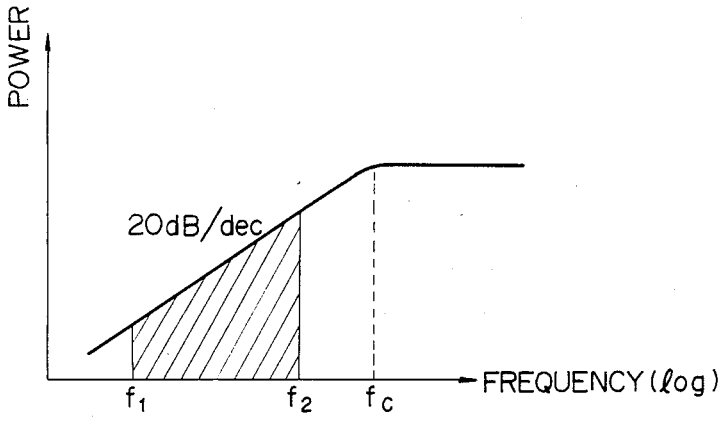

FIG. 6(a) shows a circuit diagram of a differential circuit in which the symbol C is a capacitor (in Farad), and R is a resistor (in ohm), and FIG. 6(b) is a Bode diagram of FIG. 6(a), in which the horizontal axis shows a logarithmic frequency and the vertical axis shows the square amplitude response. In FIG. 6(b), the symbol $f_1$ is the lower limit frequency of the passband, $f_2$ is the upper limit frequency of the passband, and $f_c$ is the cutoff frequency of the circuit shown in FIG. 6(a), and satisfies $f_c=1/(2\pi RC)$. The differential circuit in the present text is defined so that it has a frequency response with the slope of 20 dB/decade in the passband as shown in FIG. 6(b). When $f_c$ is larger than $f_2$, the response of the differential circuit coincides with that of a primary high-pass filter in cutoff frequency band. Some minor errors of the value R or C do not affect differential characteristics themselves, although they affect to the shift of $f_c$, and a small level shift of a signal. So, a differential circuit of the present invention does not need accurate value in each element, and can be made with a low production cost.

Figure 7:
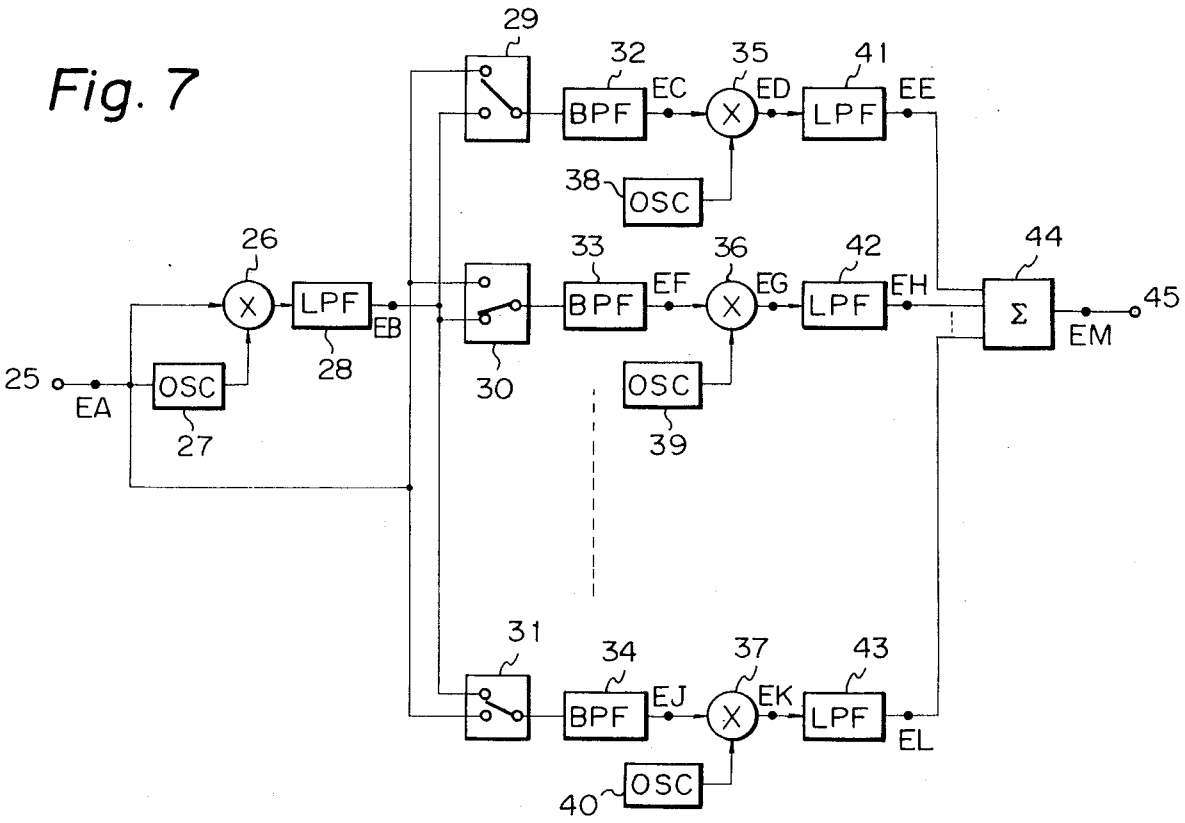
FIG. 7 is a block diagram of a spectrum scrambler according to the present invention, FIGS. 8(a)-8(m) examples of a spectrum observed at each observation point in FIG. 7.
Figures 8A, 8B, 8C:
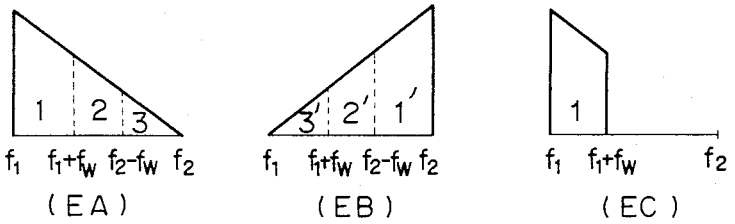
Figure 8:
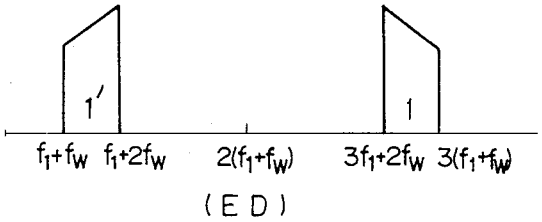
Figure 8:
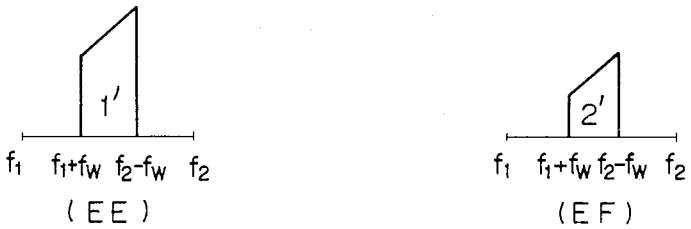

FIG. 7 shows a block diagram of a spectrum scrambler according to the present invention. In the same figure, the numeral 25 is an input terminal, 26 is a frequency mixer, 27 is a local oscillator, 28 is a low-pass filter, 29 through 31 are switches, 32 through 34 are band-pass filters, 35 through 37 are mixers, 38 through 40 are variable frequency local oscillators, 41 through 43 are low-pass filters with variable cutoff frequency, 44 is an adder, and 45 is an output terminal. Also, the symbols EA, EB, . . . , EM show the observation points. The spectrum of each observation point is show in FIG. 8, when signals with such spectrum of FIG. 8(a) are applied to the input terminal 25. In FIG. 8, the symbols (EA through EM) show the spectrums which are observed at the points indicated by the same symbols.

It is supposed that the output frequency of the local oscillator 27 is fixed to $f_0(=f_1+f_2)$, the cutoff frequency of the low-pass filter 28 is $f_2$, and the pass band of the band-pass filters 32 through 34 are $[f_1, f_1+f_w]$, $[f_1+f_w, f_1+2f_w]$, . . . , $(f_2-f_w, f_2]$, where $f_w=(f_2-f_1)/m$, and m is the number of the divided frequency bands for spectrum scramble.

It is assumed here that the value m is taken to be three for easy of understanding the following explanation.

It is supposed that the oscillation frequencies of the variable frequency local oscillators, 38, 39 and 40 are $2[f_1+f_w]$, $2[f_1+f_w]$, and $2f_2-f_w$, respectively, and the cutoff frequencies of the variable cutoff frequency lowpass filters 41, 42 and 43 are $f_1+2f_w$, $f_1+f_w$, and $f_2$, respectively, and the switches 29, 30 and 31 are connected to EA side, EB side, and EA side, respectively. When the input signals applied to the input terminal 25 have such a spectrum as shown in FIG. 8(a) (EA), the spectrum inverted signal as shown in FIG. 8(b) (EB) is observed at the point (EB). Each bandpass filter 32 through 34 derives one third of frequency band from the input signal as shown in FIGS. 8(c), 8(f) and 8(j), respectively. The sub-frequency band with (') (dash) shows that the spectrum is inverted.

The switch 29 and the filter 32 derive the first spectrum component in the frequency band (1) from EA, and therefore, the spectrum at the point EC is given as shown in FIG. 8(c). Then, the mixer 35 provides the product of the output (EC) of the bandpass filter 32 and output of the local oscillator 38. Here, the output signals of the mixer 35 have a pair of side bands as shown in FIG. 8(d) (ED). Next, the lowpass filter 41 derives the lower side-band component from the product output of the mixer 35, then, the spectrum (EE) is obtained at the output EE of the filter 41 as shown in FIG. 8(e). Thus, the first spectrum component (1) is inverted, and is also shifted upward by frequency $f_w$.

Concerning the second spectrum component (2), the switch 30 and the bandpass filter 33 derive the inverted component (2'), then, the mixer 36 which receives the output of the local oscillator 39 provides a pair of sidebands as shown in FIG. 8(g), then, the lowpass filter 42 eliminates only the upper side-band. Therefore, the spectrum at the point (EH) is shown in FIG. 8(h), in which the second component (2) is shifted upward by frequency $f_w$.

Concerning the third component (3), the switch 31 and the bandpass filter 34 derive the third component as shown in FIG. 8(j), then, the mixer 37 which receives the local frequency by the oscillator 40 provides a pair of side bands as shown in FIG. 8(k) at the point EK, then, the lowpass filter 43 provides the lower sideband as shown in FIG. 8(l) at the point EL. The spectrum component (3) is inverted in the same sub-band.

The adder 44 provides the sum of the signals at the points EE, EH and EL, then, the output of the adder 44 at the point EM is shown in FIG. 8(m).

It should be noted that the signal in FIG. 8(m) has the privacy or secret facility to the original signal in FIG. 8(a).

The number of combinations of the sub-frequency bands depends upon both the connection ($2^m$) of the switches 29–31 and the permutation (m!) of sub-frequency band, then, the number of the combination amounts to $2^m m!$.

At a receive side, a scrambled spectrum is restored to the original spectrum by the de-scrambler installed at a receive side. The structure of a de-scrambler is similar to that of a scrambler of FIG. 7. In a de-scrambler, the component (2) should be shifted upward by $f_w$, the component (1') should be inverted and shifted downward by $f_w$, and the component (3) should be inverted in the same domain. For that operation, the switch 29 in FIG. 7 is connected to the ED side, the switch 30 to EA side, the switch 31 to ED side, and the frequencies of the oscilators 38 through 40 are designed to be $2f_1+3f_w$, $2(f_1+f_w)$, and $2(f_1+2f_w)$, respectively. Further, the cutoff frequencies of the lowpass filters 41 through 43 are designed to be $f_2$, $F_1+f_w$, and $f_1+2f_w$, respectively.

Now, the operation of the present invention is theoretically analyzed.

In FIG. 5(a), when arbitrary signals G(f) are applied to the input terminal 20, the signal power at the point (f) is $f^2G(f)$ which is the output of the differential circuit 21. Then, the signal $f^2G(f)$ is applied to the scrambler 22, then, the signal having the spectrum $S[f^2G(f)]$ appears at the point (g), where S[*] shows the scramble operation. Thus, the modulation index of $Dev_{IE}$ of the FM modulator 23 is defined by the power at the input point (g) of the modulator, and is expressed as follows.

$$Dev_{IE} = \int_{f_1}^{f_2} S[f^2G(f)]df \tag{15}$$

It should be noted that the integrand in the equation (15) is $S[f^2G(f)]$, but it is not $f^2S[f^2G(f)]$. That is because the modulator 23 is an FM modulator. If a PM modulator is employed, this integrand turn to be $f^2S[f^2G(f)]$.

Now, it is proved below that $Dev_{IE}$ given by equation (15) is equal to $Dev_{PM}$. Where, $Dev_{PM}$ is the modulation index when no scrambling is used.

The following equation (15') has the same meaning as that of the equation (15) by the definition of the integration.

$$Dev_{IE} = \lim_{\Delta f \to 0} \sum_{i=1}^{N} S[f_i^2G(f_i)]\Delta f \tag{15'}$$

where $\Delta f = (f_2 - f_1)/N$

It should be noted in the equation (15') that the order or sequence of addition (i=1 through i=N) is arbitrary. Eq. 15' is, therefore, modified as follows.

$$Dev_{IE} = \lim_{\Delta f \to 0} \sum_{i \in I} S[f_i^2G(f_i)]\Delta f \tag{15''}$$

where, I is a set of {1, 2, . . . , N}.

Figure 9:
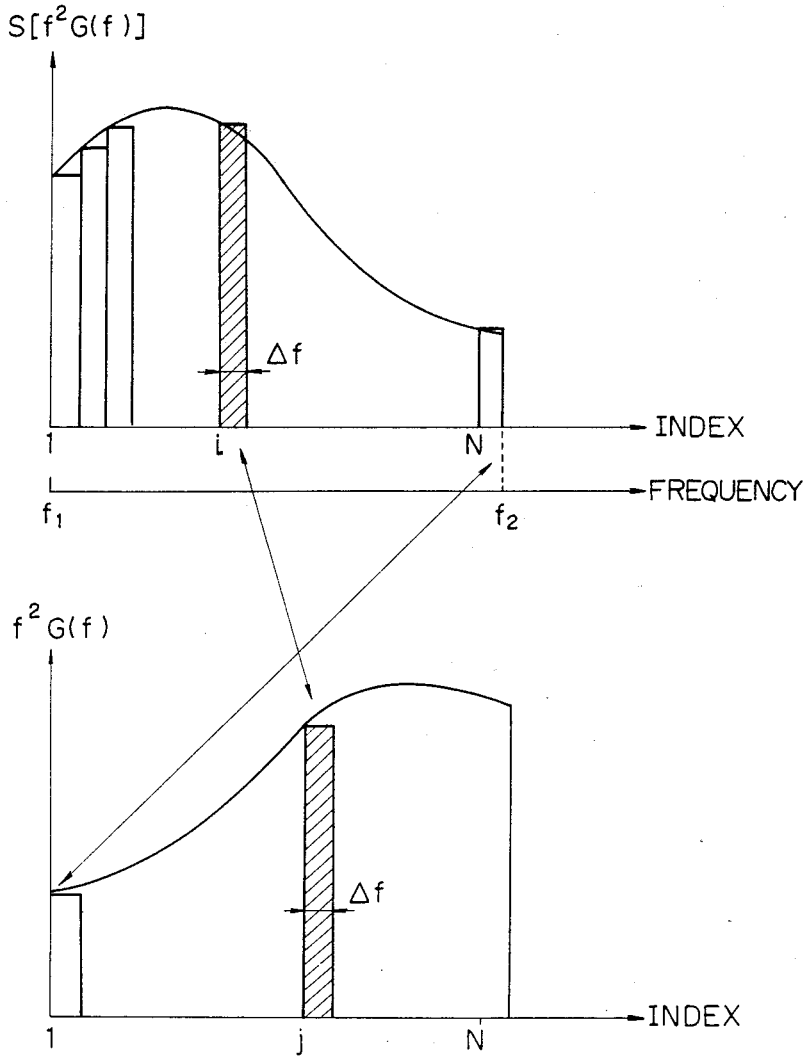
FIG. 9 shows explanatory drawings of the spectrum scrambling operation of a spectrum scramble.

Considering the scramble and/or the de-scramble, it is the conversion or the relocation of the spectrum between the power spectrum $f^2G(f)$ shown in FIG. 9(b) and the power spectrum $S[f^2G(f)]$ shown in FIG. 9(a) on the frequency domain. In FIG. 9(a), the infinitely narrow frequency band $\Delta f$ is derived, and is located on the frequency domain in FIG. 9(b). When the re-location of each narrow sub-frequency band is carried out for all the sub-bands, the de-scramble shown in FIG. 9(b) is accomplished. Similarly, the scramble is the conversion from FIG. 9(b) to FIG. 9(a). According above considerations, the value $Dev_{IE}$ in the equation (15'') is independent from the order or the sequence of the addition, so long as each addition is accomplished only once.

Accordingly, $Dev_{IE}$ in the equation (15'') is also given by the equation (16).

$$Dev_{IE} = \lim_{\Delta f \to 0} \sum_{i \in I} f_i^2G(f_i)\Delta f \tag{16}$$

The equation (16) is changed to the equation (16') according to the definition of the integration.

$$Dev_{IE} = \int_{f_1}^{f_2} f^2G(f)df = Dev_{PM} \tag{16'}$$

Accordingly, $Dev_{IE} = Dev_{PM}$ is proved for arbitrary input signals G(f), and arbitrary spectrum scrambles S[*].

Figure 10:
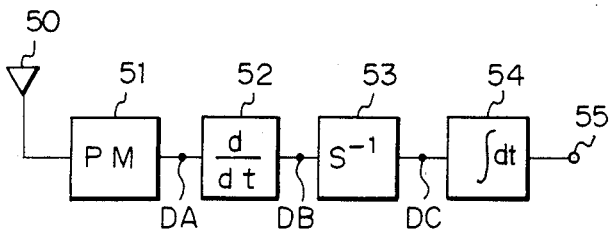
FIGS. 10 and 11 are block diagrams of reception system which is used as a reception system for the present transmission system.
Figure 11:
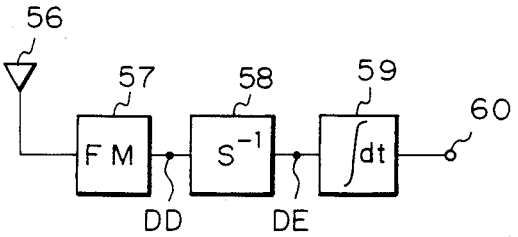

FIG. 10 is a block diagram of a receiver according to the present invention, and FIG. 11 is the modification of FIG. 10. In those figures, the numeral 50 is a receive antenna, 51 is a PM demodulator, 52 is a differential circuit, 53 is a spectrum de-scrambler, 54 is an integrator circuit, 55 is an output terminal, 56 is a receive antenna, 57 is an FM demodulator, 58 is a spectrum de-scrambler, 59 is an integration circuit, and 60 is an output terminal. The symbols DA through DE are observation points. The combination of the Pm demodulator and the differential circuit in FIG. 10 is replaced to the FM demodulator in FIG. 11, and it should be appreciated that the replacement does not alter the function of a receiver.

The differential circuit 52 is similar to that of (21) in FIG. 5, the spectrum de-scramblers 53 and 58 are similar to that of (22) of FIG. 5.

Figure 12A:
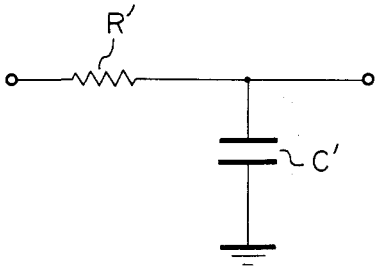
FIG. 12(a) is an integration circuit.
Figure 12B:
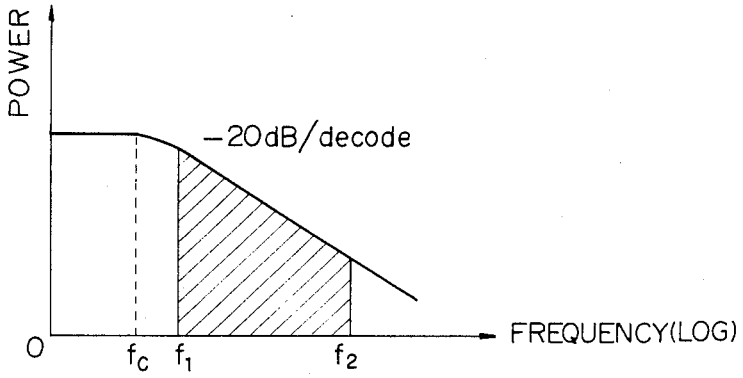
FIG. 12(b) is frequency response of the circuit shown in FIG. 12(a).

The integration circuits (54) and (59) are shown in FIG. 12(a), where R' is a resistor (ohm), C' is a capacitor (Farad). FIG. 12(b) is the Bode diagram showing the frequency response of the circuit of FIG. 12(a), in which the horizontal axis shows logarithmic frequency, and the vertical axis shows power, $f_1$ and $f_2$ are lower and upper limit frequencies, respectively, $f_c'$ is cutoff frequency of a primary lowpass filter, and $f_c' = 1/2\pi R'C'$ is satisfied.

When $f_c < f_1$ is satisfied, the frequency response of a primary lowpass filter below the cutoff frequency coincides with an integration filter. Small errors of R' and C' do not affect to the integration characteristics (−20 dB/decade), although they partially affect the cutoff frequency $f_c'$.

When the transmitter in FIG. 5 is combined with the receiver in FIG. 10 (or FIG. 11), a privacy communication system is obtained.

In communication operation, a privacy key for determining characteristics of a spectrum scrambler 22 in FIG. 5 is informed to a receive side beforehand, so that a public key encoding is adopted to privacy key in both transmit side and receive side. Since the input of the FM modulator 23 in FIG. 5 is $S[f^2G(f)]$, the demodulated signal at the point DD in FIG. 11 is $S[f^2G(f)]$, when the transmission path is distortion free. Similarly, the demodulated spectrum at the point DA in FIG. 10 is $f^{-2}S[f^2G(f)]$. In case of FIG. 10, the spectrum at the point DB is the differentiated signal of the demodulated output, and is $f^2[f^{-2}S[f^2G(f)]] = S[f^2G(f)]$, and the spectrum at the point DC is the de-scrambled one and is $S^{-2}[S[f^2G(f)]] = f^2G(f)$, and the signal at the output terminal 55 is the integral of the de-scrambled output and is $f^{-2}[f^2G(f)] = G(f)$. Accordingly, the combination of the transmitter of FIG. 5(a) (or FIG. 5(b)) and the receiver of FIG. 10 provides the receive signal which is the exactly same as the input signal at the transmit input terminal 20.

When a noise is superimposed in the transmission path, the noise spectrum of the PM demodulated output has the integral characteristics. Accordingly, the demodulated output signal is differentiated by the unit 52 so that the noise has a flat characteristic, and then, de-scrambled by the unit 53. Then, the signal is integrated by the unit 54 so that the output noise characteristics are the same as the demodulated PM signal.

In case of FIG. 11, the FM de-modulated output $S[f^2G(f)]$ is directly de-scrambled, and the signal $S^{-1}[Sf^2G(f)]]=f^2G(f)$ appears at the point DE. The de-scrambled signal is then integrated and the final output signal $f^{-2}[f^2G(f)]=G(f)$ is obtained at the output terminal 60. So, the final output signal of FIG. 11 is completely the same as that of FIG. 10.

Decisively, some specific effects produced by the present invention are listed below.

(1) The modulation index $Dev_{IE}$ for a scrambled signal is always the same as the modulation index $Dev_{PM}$ for a non-scrambled signal even if an arbitrary scramble S[*] and arbitrary input signal G(f) are employed. So, no increase of frequency bandwidth occurs by introducing a spectrum scramble privacy system to a PM modulation communication system.

(2) The signal to noise ratio (S/N) at a transmit side is improved by about 9 dB as compared with that of a conventional communication system, because $Dev_{IE}$ is equal to $Dev_{PM}$.

(3) A transmitter is composed merely by a differential circuit,.a spectrum scrambler, and an FM modulator, and therefore, the structure of a transmitter is simple, and it is economical.

From the foregoing it will now be apparent that a new and improved transmission system has been found. It should be understood of course that the embodiments disclosed are merely illustrative and are not intended to limit the scope of the invention. Reference should be made to the appended claims, therefore, rather than the specification as indicating the scope of the invention.

What is claimed is:

1. A wireless transmission system for a phase modulation system using a frequency relocator means, comprising:

an input terminal for receiving an input signal to be transmitted;

a differential circuit coupled with said input terminal;

a frequency relocator coupled with an output of said differential circuit, for relocating the spectrum of input signals;

an FM modulator coupled with an output of said frequency relocator, wherein said differential circuit and said FM modulator combine to function as a phase modulation modulator and such that a modulation index of the phase modulation is not increased during said relocation of the spectrum; and an antenna coupled with an output of said FM modulator.

2. A wireless transmission system for a phase modulation system according to claim 1, wherein said frequency relocator is a spectrum inverter.

3. A wireless transmission system for a phase modulation system according to claim 1, wherein said frequency relocator has means for dividing the spectrum of an input signal into plural sub-bands, and means of relocating said sub-bands in the frequency domain.

4. A wireless transmission system for a phase modulation system according to claim 1, wherein said differential circuit comprises a series connected capacitor, and a resistor connected between an output of said capacitor and ground, and cutoff frequency $f_c$ of the differential circuit is higher than $f_2$ which is the upper limit of a pass band of a signal.

5. The wireless transmission system of claim 1 wherein said FM modulator comprises an integration means coupled with the output of said frequency relocator and a PM modulator coupled with an output of said integration means.

* * * * *